United States Patent [19]

Chaulk

[11] Patent Number: 4,501,168

[45] Date of Patent: Feb. 26, 1985

[54] ADJUSTABLE STOP FOR POSITION CONTROL LEVER FOR DRAFT LOAD SENSING SYSTEM

[75] Inventor: Donald E. Chaulk, New Berlin, Wis.

[73] Assignee: Allis-Chalmers Corp., Milwaukee, Wis.

[21] Appl. No.: 417,700

[22] Filed: Sep. 13, 1982

[51] Int. Cl.[3] ..... G05G 5/00

[52] U.S. Cl. ..... 74/526; 74/531

[58] Field of Search ..... 74/526, 531, 565, 540; 172/7, 8, 9, 10, 11, 12

[56] References Cited

U.S. PATENT DOCUMENTS

| | | | |
|---|---|---|---|
| Re. 25,512 | 1/1964 | Presnell et al. | 172/10 |
| 1,458,013 | 6/1923 | Tampier | 74/526 |
| 2,822,737 | 2/1958 | Bunting | 172/11 X |
| 2,963,920 | 12/1960 | Hinsey | 74/531 |
| 3,042,119 | 7/1962 | Talak | 172/9 |
| 3,049,179 | 8/1962 | Bunting | 172/10 |
| 3,125,897 | 3/1964 | Zeman | 74/531 |
| 3,126,985 | 3/1964 | Selset | 74/526 X |
| 3,164,219 | 1/1965 | Orr | 74/526 X |
| 3,172,479 | 3/1965 | Ashfield et al. | 172/9 |
| 3,648,541 | 3/1972 | Hybarger et al. | 74/540 |
| 3,768,570 | 10/1973 | Green | 172/680 X |
| 3,895,679 | 7/1975 | Haupt | 172/9 |
| 3,918,527 | 11/1975 | Wagner | 172/9 |
| 3,972,249 | 8/1976 | Hansen | 74/526 |
| 4,085,806 | 4/1978 | Osujyo et al. | 172/9 |
| 4,372,612 | 2/1983 | Wiers et al. | 74/531 X |

*Primary Examiner*—Kenneth J. Dorner
*Assistant Examiner*—Rodney M. Lindsey
*Attorney, Agent, or Firm*—Arthur L. Nelson

[57] ABSTRACT

An adjustable position control lever stop in a control console of a tractor. The control levers operate a draft load sensing system through a three-point hitch between the tractor and the implement. The control levers in the control console include a draft load sensing control lever, and a position control lever which operates with the adjustable position control lever stop.

6 Claims, 5 Drawing Figures

ADJUSTABLE STOP FOR POSITION CONTROL LEVER FOR DRAFT LOAD SENSING SYSTEM

This invention relates to a draft load sensing system on a tractor and, more particularly, to an adjustable stop in a control console to adjustably reset a position control lever for a predetermined position and maintain the operating position of the implement at a predetermined height.

Agricultural tractors generally operate with a three-point hitch which is connected from the tractor to the implement. The hitch is controlled to raise and lower the implement and maintain a predetermined operating condition sensing draft load on the hitch when the draft load control lever is operated and to maintain a predetermined height of the implement relative to the terrain when the position control lever is operated. Raising and lowering of the implement is controlled through the hitch or coupling by the hydraulic weight distribution system which operates responsive to draft loads when the draft load control lever is operated or a height control when the position control lever is operated.

Applicant employs a hydraulic draft load sensing system which operates through the three-point hitch to raise and lower the implement. Position and draft control levers control the operation of the hitch. Normally, when the tractor reaches the end of the field, the implement is lifted as the tractor and implement are turned around. The implement is again lowered into operating position. To assure the implement operates at the same position, a position control lever stop, which can be adjustably set at the desired operating position, provides a reset for returning the position control lever to the previous preset position.

The Green patent, U.S. No. 3,768,570, shows a hydraulic implement control with control levers which can be reset for a predetermined operating position of the implement. Although a stop is shown for the lever, the stop is operated by a bolt and wing nut to position the lever. The position and draft control levers operate together to control the implement height. The applicant's invention provides for a means to adjustably reset the stop to the operating position through a lever stop. The lever stop can be set, released and reset in a convenient manner while adjusting the position control lever with one hand.

It is an object of this invention to provide an adjustable lever stop for controlling a position control lever in a control console for operating with a hydraulic draft load sensing system on a tractor.

It is another object of this invention to provide a control console on a tractor having a position control and a draft control lever including an adjustable lever stop to adjustably preset the operating position for the position control lever.

It is a further object of this invention to provide a control console for a tractor having a position control lever and a draft load control lever pivotally mounted in the console. A position control lever stop is also pivotally mounted in the control console having a latch mechanism which can be conveniently released and reset to the desired operating position of the position control lever to provide a reset stop for the position control lever to return the implement to its original operating position.

The objects of this invention are accomplished in a control console for a tractor pivotally supporting a draft load control lever and a position control lever and a position control lever stop. The draft control lever and the position control lever selectively operate to control a hydraulic weight distribution system to selectively raise and lower the implement responsive to draft load sensing or position control from the levers. The implement depth is set at a predetermined position responsive to positioning of the position control lever. The position control lever is operated to raise the implement out of the ground and returns the implement to its predetermined depth of operation. The position control lever stop is also pivotally mounted in the control console and is provided with a latch mechanism which can be conveniently set, released and reset to provide a stop for the position control lever to return the lever to its preset position and the implement to its previous depth of operation.

Referring to the drawings, the preferred embodiment of this invention is illustrated.

Figures 1, 2:
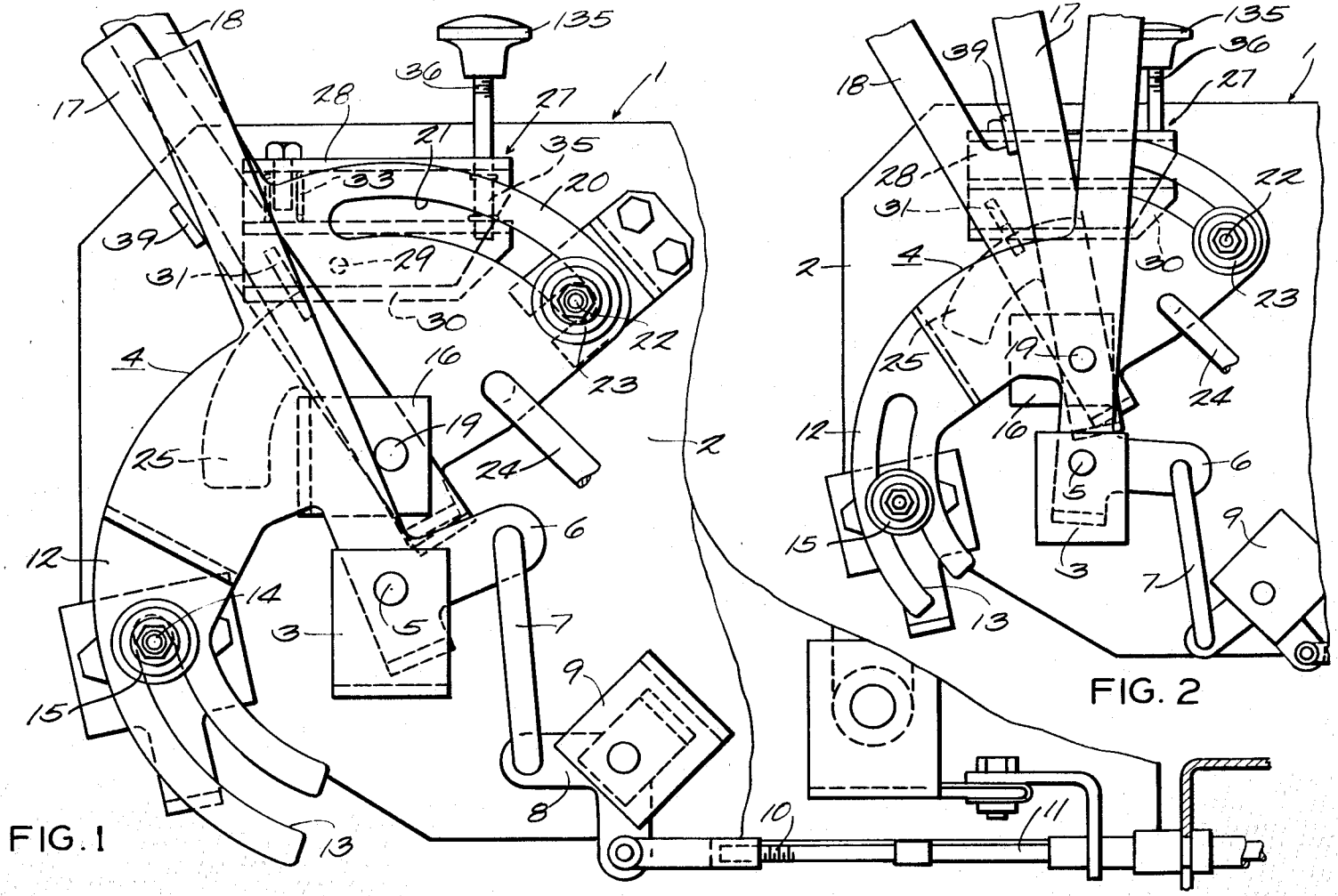
FIG. 1 illustrates a side elevation view of the control console and the position control lever engaging the stop in the operating position.
FIG. 2 illustrates a side elevation view with the position control lever retracted from its normal engaged position with the lever stop.

Referring to the drawings, the control console 1 is mounted on a sidewall 2. The bracket 3 integral with the sidewall 2 pivotally supports the position control lever 4 by means of the pin 5. Arm 6 is pivotally connected through the link 7 to a bellcrank 8 mounted on the bracket 9. Bellcrank 8 is pivotally connected to the push rod 10 which selectively operates through a cable mechanism 11 to control implement position through a three-point hitch by controlling the operation of a hydraulic weight distribution system.

An arcuate segment 12 on the position control lever 4 is formed with an arculate slot 13. A bolt 14 connected to the friction block 15 operates with the arcuate segment 12 to retain the position control lever 4 in its manually set position. A friction block may be of the type illustrated in the Haupt patent, U.S. No. 3,895,679.

Bracket 16 mounted on the sidewall 2 pivotally supports a position control lever stop 17 as well as the draft load sensing control lever 18 by means of the pin 19. Draft load control lever 18 is formed with an arcuate portion 20 which forms an arcuate slot 21 which receives the bolt 22 of the friction block assembly 23. The friction block assembly 23 retains the draft load control lever 18 in its manually set position.

The draft load control lever 18 is formed with an opening for pivotally connecting the push rod 24 which operates the draft load sensing system to control implement height responsive to draft load on the three-point hitch.

The position control lever stop 17 being pivotally supported on the shaft 19 is formed with an arcuate segment 25. The arcuate segment 25 is engaged by a latch element 31 of a latch mechanism 27 thereby providing a means of locking the lever stop 11 in any preselected position. The latch mechanism 27 includes an inverted channel-shaped latch or latch block 30 to which the latch element 31 is welded. The latch block 30 is pivotally mounted on a pivot means in the form of a pin 29 which in turn is mounted on an inverted channel-shaped support bracket 28 secured to the sidewall 2. As shown in the drawings, the pin 29 extends through flanges extending downwardly from a top wall of the latch block 30 and through flanges extending downwardly from a top wall of a support bracket 28. The latch element 31 is formed with a V-slot 32 for engaging the arcuate segment 25 of the position control lever stop 17. Normally the latch block 30 is biased to a latched position by resilient biasing means in the form of a coil compression spring 33 carried on the bolt 34 positioned vertically above the latch element 31.

Figure 4:
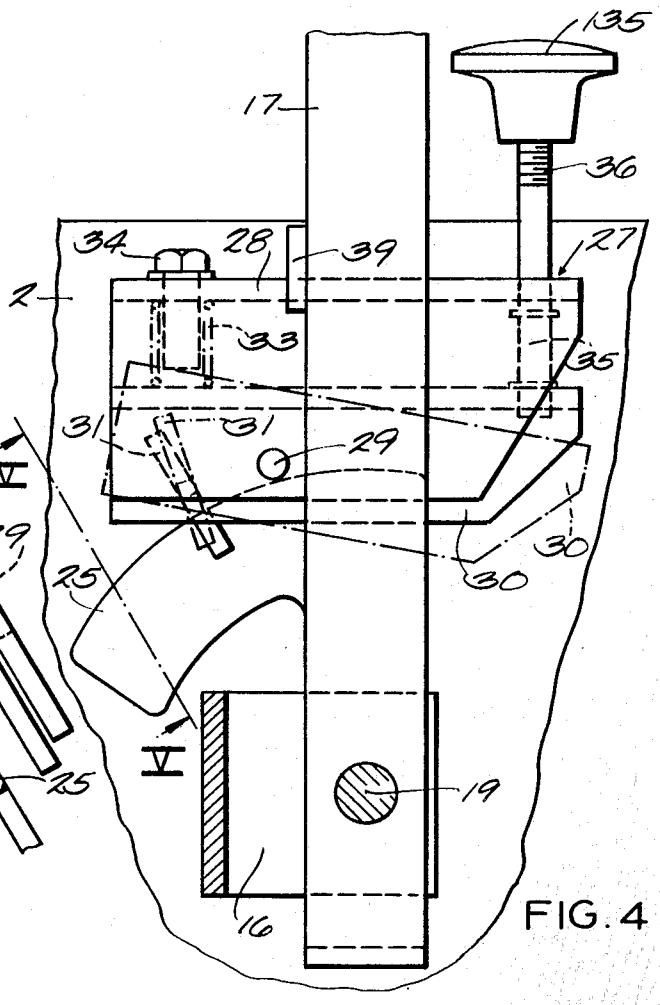
FIG. 4 is a side elevation view of the lever stop and the latch engaging an arcuate portion of the lever stop.
Figure 5:
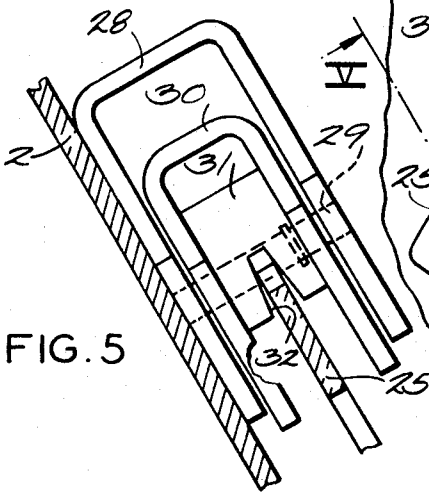
FIG. 5 is a cross section view taken on line V—V of FIG. 4.
Figure 3:
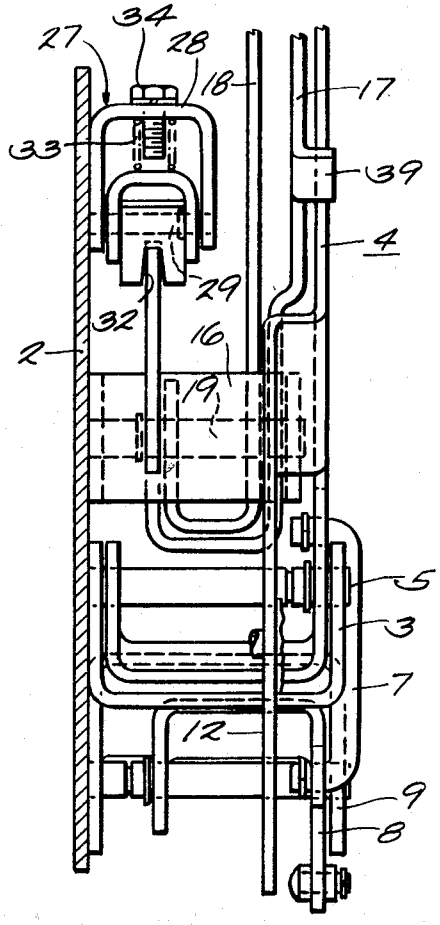
FIG. 3 illustrates a cross section view of the stationary latch engaging an arcuate portion of the lever stop.

The latch 30 can be operated by the operator depressing a manually operable control element in the form of a rod or bolt 36 whose upper end carries a knob 135 and whose lower end is operatively connected to the latch 30. As seen in FIG. 1, the rod 36 is spaced to the right of the pivot pin 29 and the spring 33 and latch element 31 are spaced in the opposite direction from the pivot pin 29. The rod end 35 of the bolt 36 extends through the bracket 28 and the latch block 30 for disengaging the latch from the arcuate segment 25. FIG. 4 illustrates the normally engaged position of the latch mechanism and the disengaged position in the phantom view in which the latch block is pivoted from a parallel position with the bracket 28. The latch assembly can be easily released by depressing the knob 135 and selectively positioning the lever stop 17 to a preselected position in the control console. Once the knob 135 is released, the latch engages holding the lever stop in a fixed position to provide a reference position for the position control lever.

The lever stop 17 is formed with a tab 39 which extends laterally from the lever and engages the position control lever 4 to define the operating position of the position control lever once the lever stop is set. This position is determined by the implement depth required by operation of the implement. Although the lever stop 17 illustrates a means of presetting the operating position for the position control lever 4, it is adapted for use with any lever such as the draft control lever as well.

During normal operation of the implement, the position control lever 4 and the draft load sensing control lever 18 are selectively operated to control the implement operating depth. Either lever may be selected to provide the operation desired. The position control lever 4 maintains a predetermined depth of the implement once the lever is set. A draft load sensing lever 18 maintains a predetermined draft load which in turn maintains the depth of the implement depending on the load carried on the coupling between the tractor and the implement. When the operator comes to the end of the field, it is necessary to raise the implement to make the turn and return down the field in the opposite direction. Accordingly, it is necessary to lift the implement and return the implement to the original operating position once the tractor is turned around.

Accordingly, if it is desirable to reposition the implement to a different depth than it was previously operating, the lever stop 17 is released by depressing the knob 135 and releasing the latch block 30 and latch element 31. As the latch mechanism 27 is released, the stop lever 17 can be pivoted to any desired position. FIG. 1 illustrates an operating position for the lever in which the tap engages the position control lever 4. In this position, the knob 135 is again released allowing the spring 33 to engage the latch element 31 on the latch block 30. Once knob 135 is released, the latch mechanism holds the lever stop 17 in a fixed position. When the position control lever 4 is returned to its normal operating position, it engages the tab 39. The friction block assembly 15 will normally hold the position control lever 4 in this position until it is repositioned by the operator.

The embodiments of the invention in which an exclusive property or privilege is claimed are defined as follows:

1. In a tractor, a control means for a hydraulic implement lift system comprising,
   - a control console including a generally upright sidewall,
   - a position control lever pivotally mounted on said console for a pivotal movement about a transverse axis, said lever being spaced from said sidewall,
   - a lever stop pivotally mounted on said sidewall having
     - a first upright handgrip portion spaced from said sidewall with an abutment part in abutable relation to said control lever to limit the pivotal movement of the latter in one direction, and
     - a latch engaging portion spaced axially from said handgrip portion and extending upwardly intermediate said handgrip portion and said sidewall, said latch engaging portion including an arcuate upper edge,
   - a support bracket secured to said sidewall and including a top wall and a downwardly extending flange spaced from said sidewall,
   - a latch disposed between said flange and said sidewall and including a latch element engageable with said arcuate upper edge of said latch engaging portion of said lever stop,
   - pivot means pivotally supporting said latch on said bracket in underlying relation to said top wall thereof,
   - resilient biasing means on said console engaging said latch and urging the latter to rotate on said pivot means whereby said latch element engages said latch engaging portion to releasably restrain said lever stop against pivotal movement and
   - a manual control element connected to said latch and operable to pivot the latter about said pivot means in opposition to said biasing means to release latch from said latch engaging portion.

2. The combination of claim 1 and further comprising a draft load control lever pivotally mounted on said control console coaxially with said lever stop and disposed between said handgrip and latch engaging portions of the latter.

3. The combination of claim 1 wherein said resilient biasing means includes a compression coil spring operatively interposed between said top wall of said support bracket and a part of said latch extending in one direction from said pivot means.

4. The combination of claim 3 wherein said spring is disposed substantially in vertical alignment with and above said latch element.

5. The combination of claim 3 wherein said manual control element includes an upright rod whose lower end extends through said support bracket and is connected to a part of said latch spaced in a second direction from said pivot means generally opposite to said one direction and wherein said manual control element includes a manually engageable part on the upper end of said rod.

6. The combination of claim 1 wherein said pivot means is a pin supported at one end by said flange of said support bracket and said latch element includes a V-shaped slot engaging said arcuate edge of said latch engaging portion of said lever stop.

* * * * *